US007971803B1

(12) United States Patent
Barlowe

(10) Patent No.: US 7,971,803 B1
(45) Date of Patent: Jul. 5, 2011

(54) PORTABLE SPRAYER HAVING AUTOMATED PRESSURIZING MEANS

(76) Inventor: David Barlowe, North Wilkesboro, NC (US)

( * ) Notice: Subject to any disclaimer, the term of this patent is extended or adjusted under 35 U.S.C. 154(b) by 158 days.

(21) Appl. No.: 12/429,268

(22) Filed: Apr. 24, 2009

(51) Int. Cl.
*B05B 9/03* (2006.01)

(52) U.S. Cl. ..... 239/146; 239/71; 239/74; 239/331; 239/332; 239/373; 239/525; 239/532; 222/333

(58) Field of Classification Search ..... 239/71, 239/74, 146, 331, 332, 333, 373, 525, 530, 239/532; 222/333
See application file for complete search history.

(56) References Cited

U.S. PATENT DOCUMENTS

| | | | | |
|---|---|---|---|---|
| 3,265,308 | A | 8/1966 | Hopkins | |
| 4,135,669 | A | 1/1979 | Bridges et al. | |
| D254,321 | S | 2/1980 | Sidor et al. | |
| 4,925,105 | A * | 5/1990 | Lin | 239/332 |
| 5,752,661 | A * | 5/1998 | Lewis | 239/332 |
| 5,931,207 | A | 8/1999 | Gianino | |
| 6,003,787 | A | 12/1999 | Fisher | |
| 6,109,548 | A * | 8/2000 | George et al. | 239/373 |
| 6,135,361 | A | 10/2000 | Grassi | |
| 7,182,280 | B2 | 2/2007 | Ye et al. | |
| 7,234,653 | B2 * | 6/2007 | Powell et al. | 239/373 |
| 7,513,444 | B1 * | 4/2009 | Kurimski et al. | 239/332 |
| 7,753,290 | B2 * | 7/2010 | Jacques et al. | 239/146 |

* cited by examiner

*Primary Examiner* — Steven J Ganey
(74) *Attorney, Agent, or Firm* — Kyle Fletcher

(57) ABSTRACT

The portable sprayer having automated pressurizing means includes a canister, air compressor, and battery compartment. In an alternative embodiment a pair of fold out wheels can extend and retract from underneath the canister to improve the overall mobility of the sprayer. In yet another embodiment, the canister includes an optional manual pump to use in the event the batteries lose their charge. In all embodiments, a cover screws onto a top of the canister to enable refilling of the canister.

15 Claims, 6 Drawing Sheets

PORTABLE SPRAYER HAVING AUTOMATED PRESSURIZING MEANS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of portable sprayers, more specifically, a portable sprayer that has a pressurizing means integrated into the design of the sprayer for use in spraying a liquid such as a pesticide, insecticide, or herbicide.

B. Discussion of the Prior Art

As a preliminary note, it should be stated that there is an ample amount of prior art that deals with portable sprayers. As will be discussed immediately below, no prior art discloses a portable sprayer with automated pressurizing means integrated into the design of the sprayer with fold out wheels or with an optional manual pumping means.

The Bridges Patent (U.S. Pat. No. 4,135,669) discloses a portable electric sprayer with a pressurized canister and a located above the canister, as opposed to a compressing means integrated into the bottom of the canister. Also, the electric sprayer does not have fold out wheels that extend out from the bottom or an optional manual pump integrated into the top of the canister in the event that the powering means becomes unavailable.

The Grassi Patent (U.S. Pat. No. 6,135,361) discloses an electric garden-spraying device for spraying fertilizer, pesticide, herbicide, and other liquids from a pressurized canister. Though the sprayer has the pressurizing means located below the canister, the sprayer does not have wheels that extend and retract from the bottom of the sprayer. Also, the sprayer does not come with an optional manual pump for use when the powering means of the pressurizing means is not available.

The Hopkins Patent (U.S. Pat. No. 3,265,308) discloses a yard and garden-spraying device that is portable with a dolly and an electric pressurized canister. However, the dolly of the garden-spraying device is not integrated into the bottom of the canister and capable of extending to and from the bottom.

The Fisher Patent (U.S. Pat. No. 6,003,787) discloses an electric pesticide spraying apparatus that includes a pump for pressurizing the canister or container that houses the liquid to be sprayed. However, the spraying apparatus does not have the pressurizing means integrated into the bottom of the canister, but rather attached via a flexible hose. Also, the pressurizing means are not portably powered.

The Ye et al. Patent (U.S. Pat. No. 7,182,280) discloses a power-spraying unit that is powered by a rechargeable battery and that sprays a pressurized liquid. However, the power-spraying unit does not include a canister with wheels that extend from beneath the canister for mobility purposes. Also, the power-spraying unit relies on a rechargeable battery to power the pressurizing means, and does not come with an optional manual pump for use when the powering means are not available.

The Gianino Patent (U.S. Pat. No. 5,931,207) discloses a portable home and garden spraying device that has an electric pump on the top with a rechargeable battery for pressurizing the canister to assist in delivering the liquid to the wand. However, the spraying device does not have the compressing means integrated into the bottom of the canister. Also, the spraying device does not include fold out wheels along the base to increase the overall mobility of the sprayer.

While the above-described devices fulfill their respective and particular objects and requirements, they do not describe a portable sprayer with automated pressuring means integrated into the bottom of the canister with a pair of pop out wheels in the base and an optional manual pump that can pressurize the canister when the powering means of the pressuring means is no longer available. In this regard, the portable sprayer departs from the conventional concepts and designs of the prior art.

SUMMARY OF THE INVENTION

The portable sprayer having automated pressurizing means includes a canister, air compressor, and battery compartment. In an alternative embodiment a pair of fold out wheels can extend and retract from underneath the canister to improve the overall mobility of the sprayer. In yet another embodiment, the canister includes an optional manual pump to use in the event the batteries lose their charge. In all embodiments, a cover screws onto a top of the canister to enable refilling of the canister.

An object of the invention is to provide a portable sprayer that has an automated pressurizing means integrated into the bottom of the canister.

A further object of the invention is to provide a portable sprayer with wheels that fold out from below the canister in order to add mobility to the canister when filled with a liquid.

A further object of the invention is to provide an optional manual pump integrated into the design of the canister such that the pump can be used in the event that the powering means for the pressurizing means is not available.

These together with additional objects, features and advantages of the portable sprayer having automated pressurizing means will be readily apparent to those of ordinary skill in the art upon reading the following detailed description of presently preferred, but nonetheless illustrative, embodiments of the portable sprayer having automated pressurizing means when taken in conjunction with the accompanying drawings.

In this respect, before explaining the current embodiments of the portable sprayer having automated pressurizing means in detail, it is to be understood that the portable sprayer having automated pressurizing means is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the portable sprayer having automated pressurizing means.

It is therefore important that the claims be regarded as including such equivalent construction insofar as they do not depart from the spirit and scope of the portable sprayer having automated pressurizing means. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
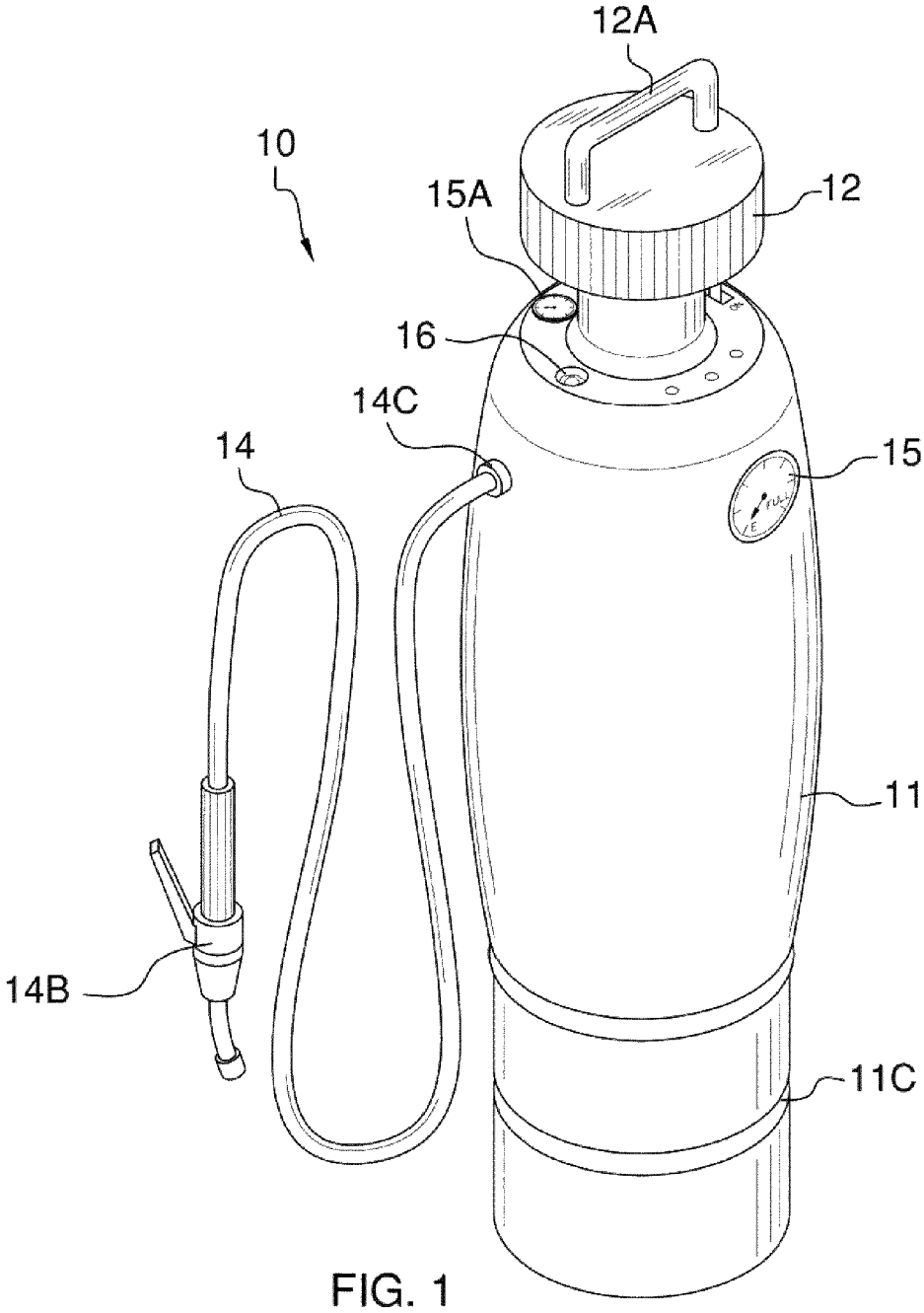
FIG. 1 illustrates an isometric view of the portable sprayer.
Figure 2:
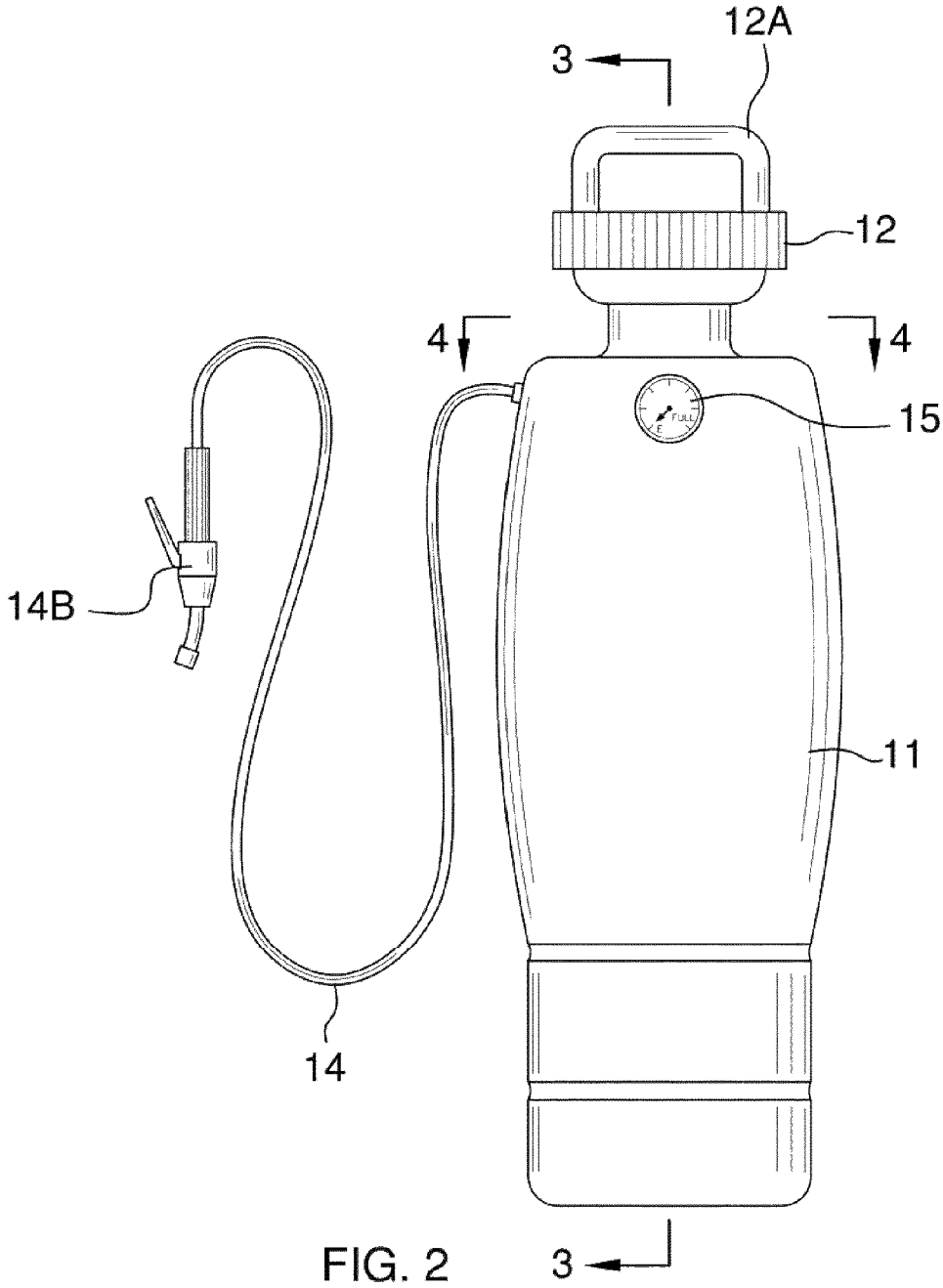
FIG. 2 illustrates a front view of the portable sprayer.
Figure 3:
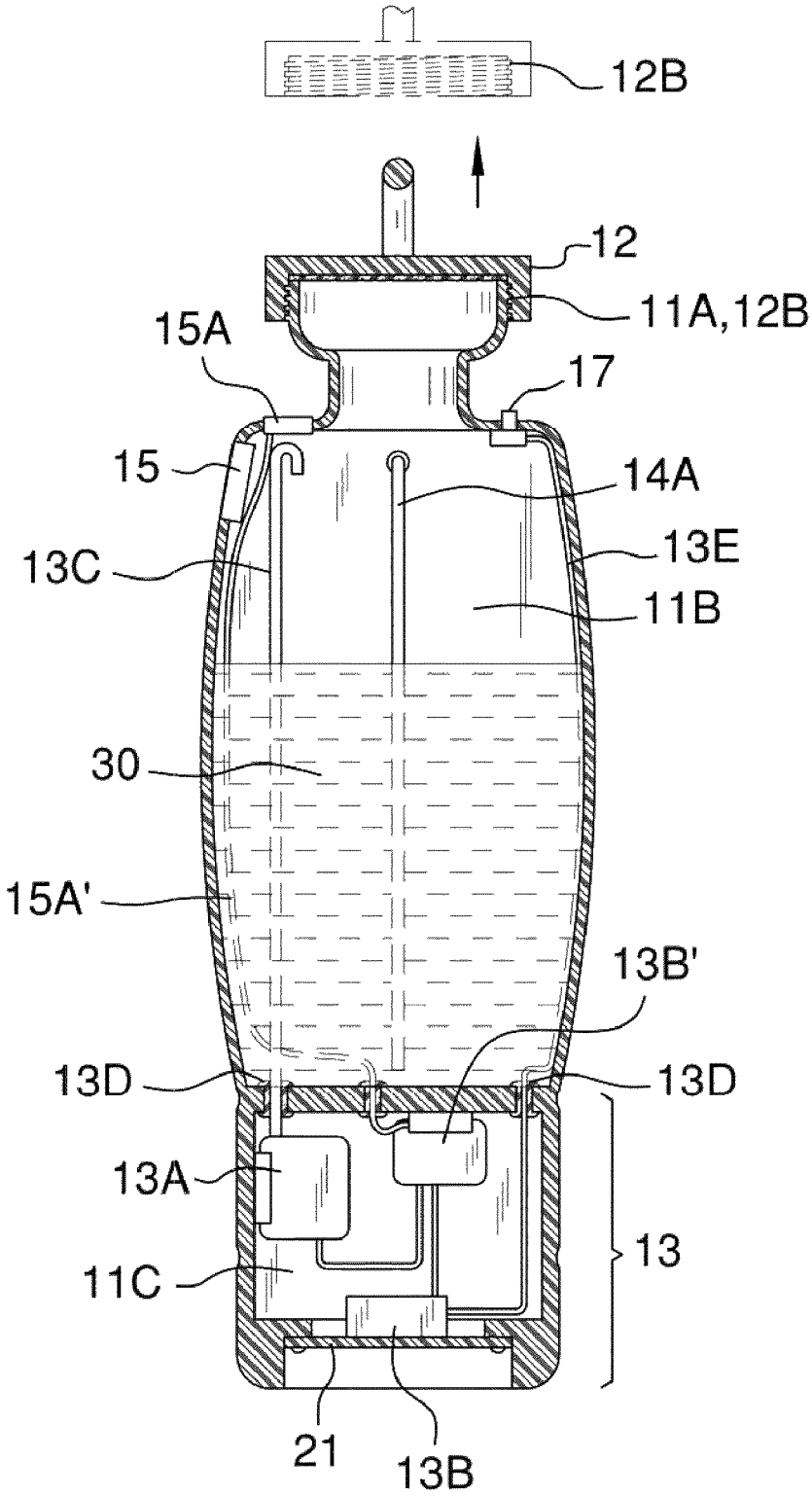
FIG. 3 illustrates a cross-sectional view of the portable prayer along line 3-3 in FIG. 2.

Detailed reference will now be made to the preferred embodiment of the invention, examples of which are illustrated in FIGS. 1-4. A portable sprayer having automated pressurizing means 10 (hereinafter invention) includes a canister 11, a screw on cover 12, a pressurizing means 13, a sprayer wand 14, a fill gage 15, and a pressure gage 15A.

The screw on cover 12 has a handle 12A for use in transporting the invention 10 around. The screw on cover 12 has internal threading 12B that corresponds to external threading 11A located at the top opening of the canister 11. The screw on cover 12 also enables refilling of a liquid 30 into the invention 10.

The pressurizing means 13 includes an air compressor 13A, a plurality of batteries 13B, a control unit 13B', an airline 13C. The airline 1C connects to the output of the air compressor 13A, and enters into a liquid reservoir 113 of the canister 11 via a seal 13D.

Located near the top of the canister 11 are a relief valve 16, an on/off switch 17, green indicator LED 18, a yellow indicator LED 19, and a red indicator LED 20. The relief valve 16 is positioned near the top of the canister 11 in order to enable excess pressure egress from the liquid reservoir 118 as a safety precaution.

The green indicator LED 18 indicates that the batteries 13B are fully charged; the yellow indicator LED 19 indicates that the batteries 13B are partially charged; and the red indicator LED 20 indicates that the batteries 13B are almost empty of a charge. The on/off switch 17 is wiredly connected to the plurality of batteries 13B via a wire 13E that passes through the liquid reservoir 11B and into the pressuring means 13 via a seal 13D.

The green, yellow, and red indicator LEDs 18-20 only operate when the on/off switch 17 is turned on in an effort to prevent unnecessary waste of the batteries 13B charge. Furthermore, the LEDs 18-20 will illuminate for a short period of time, such as 5 to 10 seconds, upon initially turning the on/off switch 17 to the "on" position in order to eliminate wasted battery charge from continuous operation.

Figure 4:
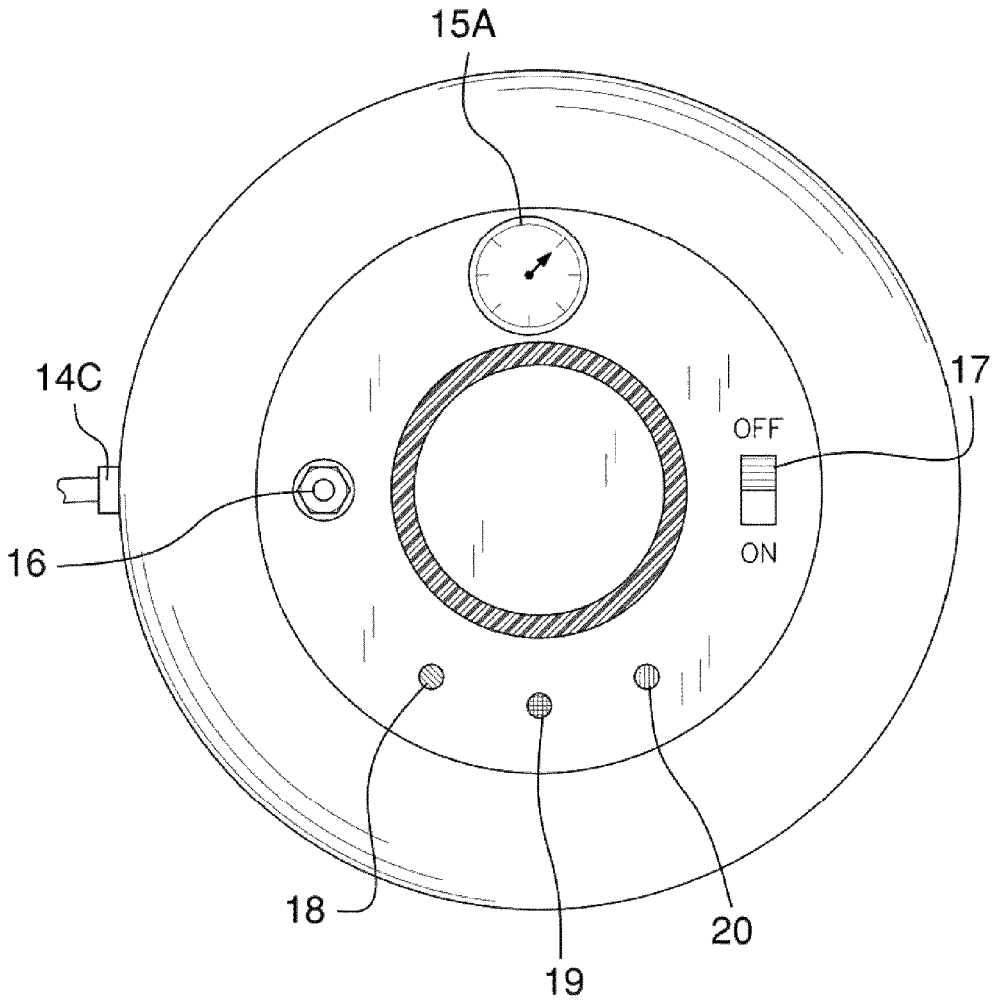
FIG. 4 illustrates a cross-sectional view of the portable sprayer along line 4-4 in FIG. 2.
Figure 4A:
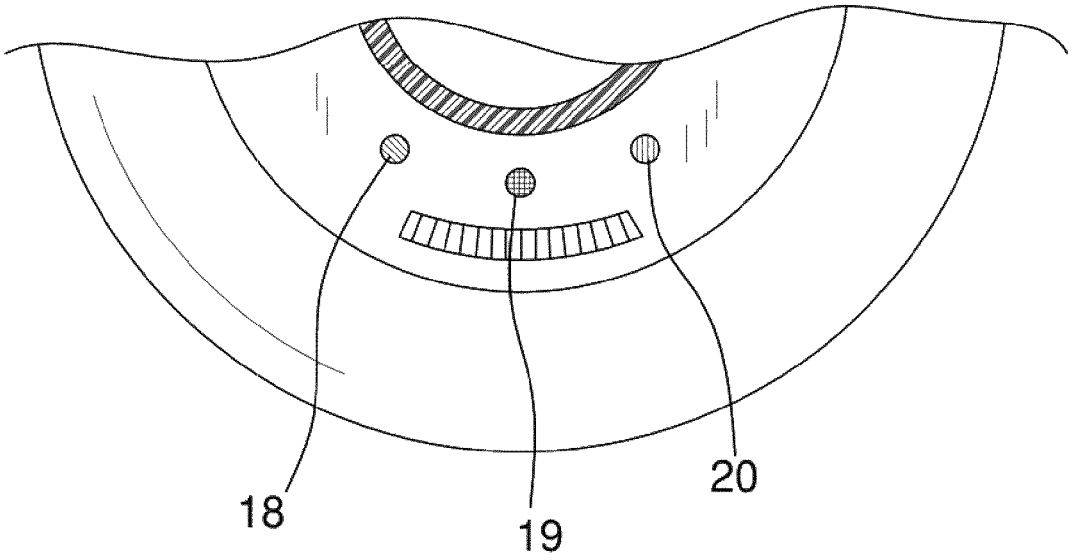
FIG. 4A illustrates a detailed cut-away view of the power prayer with a plurality of LED bars that would illuminate to reflect the percentage of charge remaining in the batteries.

It shall be noted that the LEDs 18-20 may be replaced with a series of LED bars (see FIG. 4A) that illuminate to represent the percentage of charge remaining in the batteries 13B.

The batteries 13B may comprise a plurality of disposable batteries, a plurality of rechargeable batteries, or a rechargeable battery pack.

The pressurizing means 13 are located at a bottom reservoir 11C positioned in the bottom of the canister 11. Furthermore, the pressurizing means 13 are accessible via a bottom cover 21.

The pressure gage 15A doubles as a regulator in that it indicates the actual pressure inside of the canister 11, but also relays said information via a wire 15A' to the control unit 13B'. The control unit 133' monitors the pressure inside of the canister 11, and will turn on/off the compressor 13A in order to maintain adequate pressure inside of the canister 11. The use of the pressure gage 15A in concert with the control unit 13B' insures that the batteries 13B are not over used by simply continuously running the compressor 13A.

The airline 13C connects to the output of the air compressor 13A and pumps in compressed air into the liquid reservoir 11B, thus imposing a pressure upon the liquid 30 located in the liquid reservoir 11B. The liquid 30, being under pressure, enters into a fluid line 14A, and along the sprayer wand 14 where said liquid 30 is released upon operating a valve 14B located at the end of the sprayer wand 14. The fluid line 14A passes through the liquid reservoir 11B via a seal 14C.

Figure 5:
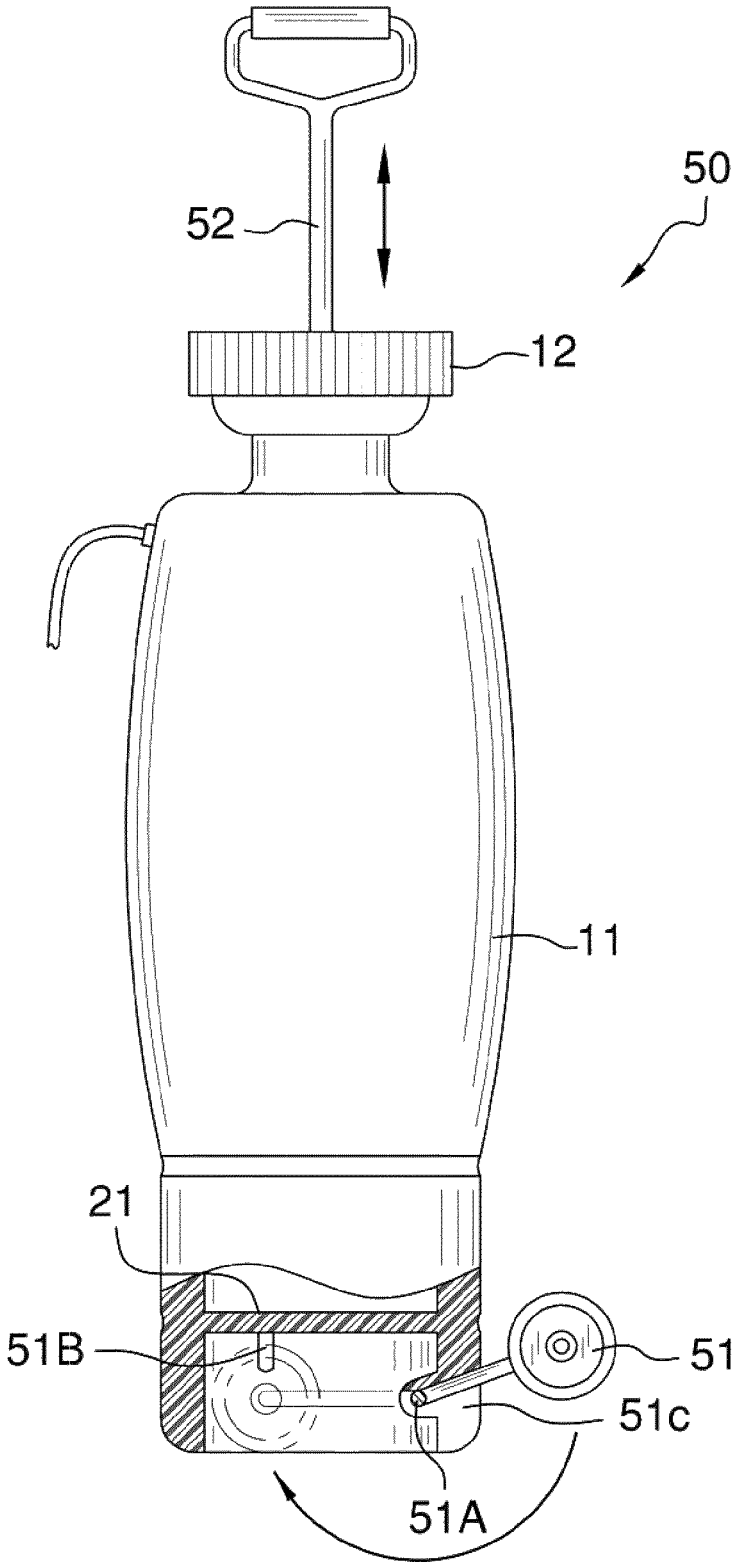
FIG. 5 illustrates a cut-away of an alternative embodiment containing the fold out wheels and arrows indicating movement of the manual pump.

Referring to FIG. 5, an alternative embodiment 50 includes all of the features of the invention 10 described above with the inclusion of some additional features that are herein considered novel in light of the prior art.

A plurality of fold out wheels 51 can extend from the bottom of the canister 11. The fold out wheels 51 rotates about a pivot point 51A, and can be locked under the canister 11 via a wheel storage clip 51B. The canister 11 has a groove 51C to enable full rotation of the fold out wheels 51 from under the canister 11. The wheel storage clip 51B extends from the bottom cover 21 and locks the fold out wheels 51 under the canister 11.

A manual pump 52 extends through the screw top cover 12 and replaces the handle 12A. The manual pump 52 provides an alternative pressurizing means for the alternative embodiment 50 in the event the batteries 13B lose their charge.

With respect to the above description, it is to be realized that the optimum dimensional relationship for the various components of the invention 10 and the alternative embodiment 50, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10 and the alternative embodiment 50.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A portable sprayer comprising:

(a) a canister;

wherein the canister is defined by a liquid reservoir and a bottom reservoir;

(b) a pressurizing means;

wherein the pressurizing means are stored in the bottom reservoir of the canister and introduces pressurized air into the liquid reservoir in order pressurize the liquid contained therein;

wherein a pressure gage is located on the canister adjacent the liquid reservoir for indicating the pressure inside of the canister, and a fill gage indicates the amount of liquid contained within the liquid reservoir;

wherein a relief valve is affixed to the liquid reservoir in order to release excess pressure from within the liquid reservoir;

(c) a sprayer wand;

wherein the sprayer wand is in fluid connection with the liquid reservoir, and further includes a release valve for dispensing pressurized liquid from the liquid reservoir;

(d) a screw on cover;

wherein the screw on cover screws onto a top opening of the liquid reservoir for refilling the liquid reservoir;

wherein the screw on cover has a handle that is a manual pump that pressurizes the contents of the liquid reservoir;

(e) a plurality of fold-out wheels;

wherein the fold-out wheels extend from a bottom surface of the canister;

wherein the fold out wheels rotate about a pivot point, and can be locked under the canister via a wheel storage clip; wherein the canister has a groove to enable full rotation of the fold out wheels from under the canister; and wherein the wheel storage clip extends from the bottom.

2. The portable sprayer as described in claim 1 wherein the pressurizing means further comprises an air compressor, a plurality of batteries, an air line, an on/off switch;

wherein the air line is connected to the output of the air compressor and introduces compressed air into the liquid reservoir;

wherein the on/off switch directs electrical current from the batteries to the air compressor.

3. The portable sprayer as described in claim 2 wherein the plurality of batteries are disposable, rechargeable, or a rechargeable battery pack.

4. The portable sprayer as described in claim 2 wherein a green indicator LED indicates a full battery charge, a yellow indicator LED indicates partial battery charge, and a red indicator LED indicates a low battery charge;

wherein the green, yellow, and red indicator LEDs do not operate unless the on/off switch is in the on position.

5. The portable sprayer as described in claim 1 wherein the bottom reservoir is accessible via a bottom cover that enables access to the pressurizing means located therein.

6. A portable sprayer comprising:

(a) a canister;

wherein the canister is defined by a liquid reservoir and a bottom reservoir;

(b) a pressurizing means;

wherein the pressurizing means are stored in the bottom reservoir of the canister and introduces pressurized air into the liquid reservoir in order pressurize the liquid contained therein;

wherein the pressurizing means further comprises an air compressor, a plurality of batteries, an air line, an on/off switch;

wherein the air line is connected to the output of the air compressor and introduces compressed air into the liquid reservoir;

wherein the on/off switch directs electrical current from the batteries to the air compressor;

wherein a relief valve is affixed to the liquid reservoir in order to release excess pressure from within the liquid reservoir;

(c) a sprayer wand;

wherein the sprayer wand is in fluid connection with the liquid reservoir, and further includes a release valve for dispensing pressurized liquid from the liquid reservoir;

(d) a screw on cover;

wherein the screw on cover screws onto a top opening of the liquid reservoir for refilling the liquid reservoir;

wherein the screw on cover has a handle that is a manual pump that pressurizes the contents of the liquid reservoir;

(e) a plurality of fold-out wheels;

wherein the fold-out wheels extend from a bottom surface of the canister;

wherein the fold out wheels rotate about a pivot point, and can be locked under the canister via a wheel storage clip; wherein the canister has a groove to enable full rotation of the fold out wheels from under the canister; and wherein the wheel storage clip extends from the bottom.

7. The portable sprayer as described in claim 6 wherein a pressure gage is located on the canister adjacent the liquid reservoir for indicating the pressure inside of the canister, and a fill gage indicates the amount of liquid contained within the liquid reservoir.

8. The portable sprayer as described in claim 6 wherein the plurality of batteries are disposable, rechargeable, or a rechargeable battery pack.

9. The portable sprayer as described in claim 8 wherein a green indicator LED indicates a full battery charge, a yellow indicator LED indicates partial battery charge, and a red indicator LED indicates a low battery charge;

wherein the green, yellow, and red indicator LEDs do not operate unless the on/off switch is in the on position.

10. The portable sprayer as described in claim 6 wherein the bottom reservoir is accessible via a bottom cover that enables access to the pressurizing means located therein.

11. A portable sprayer comprising:

(a) a canister;

wherein the canister is defined by a liquid reservoir and a bottom reservoir;

(b) a pressurizing means;

wherein the pressurizing means are stored in the bottom reservoir of the canister and introduces pressurized air into the liquid reservoir in order pressurize the liquid contained therein;

wherein the pressurizing means further comprises an air compressor, a plurality of batteries, an air line, an on/off switch;

wherein the air line is connected to the output of the air compressor and introduces compressed air into the liquid reservoir;

wherein the on/off switch directs electrical current from the batteries to the air compressor;

wherein a pressure gage is located on the canister adjacent the liquid reservoir for indicating the pressure inside of the canister, and a fill gage indicates the amount of liquid contained within the liquid reservoir;

(c) a sprayer wand;

wherein the sprayer wand is in fluid connection with the liquid reservoir, and further includes a release valve for dispensing pressurized liquid from the liquid reservoir;

(d) a screw on cover;

wherein the screw on cover screws onto a top opening of the liquid reservoir for refilling the liquid reservoir;

wherein the screw on cover has a manual pump that pressurizes the contents of the liquid reservoir in the event the batteries have no charge;

(e) a plurality of fold-out wheels;

wherein the fold-out wheels extend from a bottom surface of the canister;

wherein the fold out wheels rotate about a pivot point, and can be locked under the canister via a wheel storage clip; wherein the canister has a groove to enable full rotation of the fold out wheels from under the canister; and wherein the wheel storage clip extends from the bottom.

12. The portable sprayer as described in claim 11 wherein the plurality of batteries are disposable, rechargeable, or a rechargeable battery pack.

13. The portable sprayer as described in claim 11 wherein a green indicator LED indicates a full battery charge, a yellow indicator LED indicates partial battery charge, and a red indicator LED indicates a low battery charge;

wherein the green, yellow, and red indicator LEDs do not operate unless the on/off switch is in the on position.

14. The portable sprayer as described in claim 11 wherein a relief valve is affixed to the liquid reservoir in order to release excess pressure from within the liquid reservoir.

15. The portable sprayer as described in claim 11 wherein the bottom reservoir is accessible via a bottom cover that enables access to the pressurizing means located therein.

* * * * *